US006465152B1

(12) United States Patent
DoMinh et al.

(10) Patent No.: US 6,465,152 B1
(45) Date of Patent: Oct. 15, 2002

(54) IMAGING MEMBER CONTAINING HEAT SENSITIVE THIOSULFATE POLYMER ON IMPROVED SUBSTRATE AND METHODS OF USE

(75) Inventors: Thap DoMinh, Webster, NY (US); Shiying Zheng, Rochester, NY (US); Jennifer R. Kersten, Loveland, CO (US)

(73) Assignee: Kodak Polychrome Graphics LLC, Norwalk, CT (US)

( * ) Notice: Subject to any disclaimer, the term of this patent is extended or adjusted under 35 U.S.C. 154(b) by 0 days.

(21) Appl. No.: 09/603,013

(22) Filed: Jun. 26, 2000

(51) Int. Cl.[7] ..... B41M 5/36; B41C 1/10; B41N 3/03

(52) U.S. Cl. ..... 430/271.1; 430/275.1; 430/272.1; 430/276.1; 430/944; 430/954; 430/302; 101/456; 101/463.1; 101/451

(58) Field of Search ..... 430/275.1, 271.1, 430/272.2, 276.1, 944, 954, 964, 302; 101/456, 463.1, 451

(56) References Cited

U.S. PATENT DOCUMENTS

| | | | | |
|---|---|---|---|---|
| 3,440,050 A | | 4/1969 | Chu | 90/75 |
| 4,693,958 A | | 9/1987 | Schwartz et al. | 430/302 |
| 5,445,912 A | * | 8/1995 | Hauquier et al. | 430/159 |
| 5,512,418 A | | 4/1996 | Ma | 430/271.1 |
| 5,639,586 A | * | 6/1997 | Hauquier et al. | 430/159 |
| 5,985,514 A | | 11/1999 | Zheng et al. | 430/270.1 |
| 6,136,503 A | * | 10/2000 | Zheng et al. | 430/270.1 |

FOREIGN PATENT DOCUMENTS

| | | |
|---|---|---|
| EP | 0 293 058 | 11/1988 |
| EP | 0 652 483 | 5/1995 |
| EP | 0 830 940 | 3/1998 |
| EP | 987104 | 3/2000 |
| JP | 9-197671 | 7/1997 |
| JP | 0 830 941 | 3/1998 |

OTHER PUBLICATIONS

Patent Abstracts of Japan, vol. 1997, No. 11 (Nov. 28, 1997) for JP 09–197671.

Patent Abstracts of Japan, vol. 1996, No. 9 (Sep. 30, 1996) for JP 08–138229.

Written Opinion mailed May 30, 2002 for International Application No. PCT/US01/19708.

JP Abstract—9197671, issued Jul. 31, 1997 to Fuji Photo Film Co LTD, Derwent Abstract.

* cited by examiner

*Primary Examiner*—Cynthia Hamilton
(74) *Attorney, Agent, or Firm*—Baker Botts L.L.P.

(57) ABSTRACT

An imaging member is composed of a hydrophilic imaging layer having a hydrophilic heat-sensitive polymer containing heat-activatable thiosulfate groups, and optionally a photothermal conversion material. Upon application of energy that generates heat, such as from IR irradiation, the polymer is crosslinked and rendered more hydrophobic. The imaging layer is disposed on an interlayer on a support, which interlayer comprises a Group IVB element (such as titanium, hafnium or zirconium) compound for improved mechanical and imaging properties. The exposed imaging member can be contacted with a lithographic printing ink and used for printing with or without post-imaging wet processing. This imaging member is particularly useful for direct write imaging using IR lasers or thermal printing heads.

35 Claims, No Drawings

IMAGING MEMBER CONTAINING HEAT SENSITIVE THIOSULFATE POLYMER ON IMPROVED SUBSTRATE AND METHODS OF USE

FIELD OF THE INVENTION

This invention relates in general to lithographic imaging members, and particularly to heat-sensitive imaging members that can be used with or without wet processing after imaging. The invention also relates to a method of digitally imaging such imaging members, and to a method of printing using them.

BACKGROUND OF THE INVENTION

The art of lithographic printing is based upon the immiscibility of oil and water, wherein an oily material or ink is preferentially retained by an imaged area and the water or fountain solution is preferentially retained by the nonimaged areas. When a suitably prepared surface is moistened with water, and ink is then applied, the background or nonimaged areas retain the water and repel the ink while the imaged areas accept the ink and repel the water. The ink is eventually transferred to the surface of a suitable substrate, such as cloth, paper or metal, thereby reproducing the image.

Very common lithographic printing plates include a metal or polymer support having thereon an imaging layer sensitive to visible or UV light. Both positive- and negative-working printing plates can be prepared in this fashion. Upon exposure, and perhaps post-exposure heating, either imaged or nonimaged areas are removed using wet processing chemistries.

Thermally sensitive printing plates are less common. Examples of such plates are described in U.S. Pat. No. 5,372,915 (Haley et al). They include an imaging layer comprising a mixture of dissolvable polymers and an infrared radiation absorbing compound. While these plates can be imaged using lasers and digital information, they require wet processing using alkaline developer solutions.

It has been recognized that a lithographic printing plate could be created containing an IR absorbing layer. For example, Canadian 1,050,805 (Eames) discloses a dry planographic printing plate comprising an ink receptive substrate, an overlying silicone rubber layer, and an interposed layer comprised of laser energy absorbing particles (such as carbon particles) in a self-oxidizing binder (such as nitrocellulose). Such plates were exposed to focused near IR radiation with a $Nd^{++}$YAG laser. The absorbing layer converted the infrared energy to heat thus partially loosening, vaporizing or ablating the absorber layer and the overlying silicone rubber. The plate was developed by applying naphtha solvent to remove debris from the exposed image areas. Similar plates are described in *Research Disclosure* 19201, 1980 as having vacuum-evaporated metal layers to absorb laser radiation in order to facilitate the removal of a silicone rubber overcoated layer. These plates were developed by wetting with hexane and rubbing. $CO_2$ lasers are described for ablation of silicone layers by Nechiporenko & Markova, PrePrint 15th International IARIGAI Conference, June 1979, Lillehaminer, Norway, Pira Abstract 02-79-02834. Typically, such printing plates require at least two layers on a support, one or more being formed of ablatable materials. Other ablation imaging processes are described for example in U.S. Pat. No. 5,385,092 (Lewis et al), U.S. Pat. No. 5,339,737 (Lewis et al), U.S. Pat. No. 5,353,705 (Lewis et al), U.S. Pat. No. Reissue 35,512 (Nowak et al) and U.S. Pat. No. 5,378,580 (Leenders).

While the noted printing plates used for digital, processless printing have a number of advantages over the more conventional photosensitive printing plates, there are a number of disadvantages with their use. The process of ablation creates debris and vaporized materials that must be collected. The laser power required for ablation can be considerably high, and the components of such printing plates may be expensive, difficult to coat, or unacceptable in resulting printing quality. Such plates generally require at least two coated layers on a support.

Thermally switchable polymers have been described for use as imaging materials in printing plates. By "switchable" is meant that the polymer is rendered from hydrophilic to relatively more hydrophobic, or from hydrophobic to relatively more hydrophilic, upon exposure to heat.

U.S. Pat. No. 4,634,659 (Esumi et al) describes imagewise irradiating hydrophobic polymer coatings to render exposed regions more hydrophilic in nature. While this concept was one of the early applications of converting surface characteristics in printing plates, it has the disadvantages of requiring long UV light exposure times (up to 60 minutes) and the plate's use is in a positive-working mode only.

In addition, EP-A 0 652 483 (Ellis et al) describes lithographic printing plates imageable using IR lasers, and which do not require wet processing. These plates comprise an imaging layer that becomes more hydrophilic upon the imagewise exposure to heat. This coating contains a polymer having pendant groups (such as t-alkyl carboxylates) that are capable of reacting under heat or acid to form more polar, hydrophilic groups. Imaging such compositions converts the imaged areas from hydrophobic to relatively more hydrophilic in nature, and thus requires imaging the background of the plate, which is generally a larger area. This can be a problem when imaging to the edge of the printing plate is desired.

Positive-working photoresists and printing plates having crosslinked, UV-sensitive polymers are described in EP-A 0 293 058 (Shirai et al). The polymers contain pendant iminosulfonate groups that are decomposed upon UV exposure, generating a sulfonic group and providing polymer solubility.

U.S. Pat. No. 5,512,418 (Ma) describes the use of polymers containing pendant ammonium groups for thermally induced imaging. U.S. Pat. No. 4,693,958 (Schwartz et al) also describes a method of preparing printing plates that are wet processed. The imaging layers contain polyamic acids and vinyl polymers containing quaternary ammonium groups. Japanese Kokai 9-197,671 describes a negative-working printing plate and imaging method in which the imaging layer includes a sulfonate-containing polymer, an IR radiation absorber, a novolak resin and a resole resin.

EP 0 830940A (Vershueren et al) and EP 0 830,941 (Vershueren et al) describe titanium-containing layers on the back sides of metal or polyester supports in driographic printing plates.

U.S. Pat. No. 5,985,514 (Zheng et al) describes useful heat-sensitive imaging thiosulfate polymers that can be used successfully to prepare printing plates. The graphic arts industry is continually seeking improved printing plates for either short or long run length, improved photospeed, faster roll-up, longer shelf life and more invariance in coating formulations.

SUMMARY OF THE INVENTION

The problems noted above are overcome with an imaging member comprising a support having thereon a hydrophilic imaging layer comprising a hydrophilic heat-sensitive thiosulfate polymer, and disposed between the support and the hydrophilic imaging layer, an interlayer comprising a Group IVB element compound.

In preferred embodiments, the heat-sensitive thiosulfate polymer comprises recurring units comprising a heat-activatable thiosulfate group that is represented by structure I:

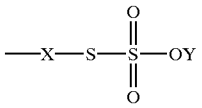

wherein X is a divalent linking group, and Y is hydrogen or a cation.

This invention also includes a method of imaging comprising:

A) providing the imaging member described above, and

B) imagewise exposing the imaging member to provide exposed and unexposed areas in the imaging layer of the imaging member, whereby the exposed areas are rendered more hydrophobic than the unexposed areas by the heat generated by the imagewise exposing.

An additional method includes steps A and B noted above as well as:

C) in the presence of water or a fountain solution, contacting the imagewise exposed imaging member with a lithographic printing ink, and imagewise transferring the printing ink from the imaging member to a receiving material.

The imaging member of this invention has a number of advantages, thereby avoiding the problems of known printing plates. Specifically, the problems and concerns associated with ablation imaging (that is, imagewise removal of surface layer) are avoided because imaging is accomplished by "switching" (preferably irreversibly) the exposed areas of its printing surface to be more hydrophobic, or oil-receptive by heat generated or provided during exposure to an appropriate energy source. The resulting imaging members display high ink receptivity in exposed areas and excellent ink/water discrimination. The imaging members also perform well with or without wet chemical processing after imaging to remove the unexposed areas. Preferably, no wet chemical processing (such as processing using an alkaline developer) is used in the practice of this invention. The imaging members are durable because the exposed areas are crosslinked during imaging. The printing members resulting from imaging the imaging members of this invention are generally negative-working in nature.

These advantages are achieved by using a specific hydrophilic heat-sensitive polymer in the hydrophilic imaging layer. These polymers have heat-activatable thiosulfate groups (also known as Bunte salts) pendant to the polymer backbone. These pendant groups are believed to provide crosslinking sites upon exposure to heat. Such heat-activatable thiosulfate groups are described in more detail below.

In addition, the imaging members of this invention have additional significant advantages because of the particular interlayer between the heat-sensitive imaging layer and the support.

In one embodiment, the interlayer results from the treatment of a metal (for example, aluminum) support with a solution containing one or more Group IVB element compounds (such as zirconium, titanium or hafnium compounds).

In a second embodiment, the support is coated with a coating formulation that includes one or more Group IVB element compounds (such as zirconium, titanium or hafnium compounds), with or without binders, to provide the desired mechanical and imaging properties.

The novel combination of the special interlayer and thiosulfate heat-sensitive polymer requires less photothermal conversion material (such as infrared radiation sensitive dyes) for the same heat-sensitivity, provides longer run length, greater photospeed, faster roll-up and longer shelf life. In addition, there is better adhesion between the heat-sensitive composition and the support, and any variations in the heat-sensitive composition are less likely to adversely affect the performance of the imaging members.

DETAILED DESCRIPTION OF THE INVENTION

The imaging members of this invention comprise a suitable support, the interlayer described herein and one or more additional layers thereon that are heat-sensitive including an outer imageable heat-sensitive layer containing a heat-sensitive thiosulfate polymer.

Useful support materials can include a metal (such as aluminum, zinc, nickel or copper), glass or polymeric substrate (such as a polyester, polycarbonate or polystyrene film). Aluminum and polyester substrates are preferred in these embodiments. There can also be an intermediate layer, such as a gelatin or polymeric subbing layer on the metal, glass or polymeric support. However, in order to obtain the maximum advantages of the present invention, the heat-sensitive composition is disposed directly on the interlayer that is disposed directly on the support.

In one embodiment, the support is a metal support that has been treated with an aqueous solution containing a titanium, hafnium or zirconium compound, or a mixture of two or more of such compounds (at from about 0.5 to about 3 weight %). Treated aluminum supports are the preferred supports in this particular embodiment. This treatment can be carried out at a suitable temperature at from about 20 to about 100° C., and preferably at from about 40 to about 80° C. for a time of from about 10 seconds to about 5 minutes (preferably from about 30 to about 120 seconds). Further details of this treatment are provided in U.S. Pat. No. 3,440,050 (Chu), incorporated herein by reference.

More preferred embodiments of this invention include polyester substrates having a layer disposed thereon containing a Group IVB element compound. These embodiments can also include gelatin intermediate layers between the substrates and the interlayers. The interlayer is disposed thereon from a coating formulation that includes the Group IVB element compound(s), one or more suitable solvents and optionally one or more binders. The useful Group IVB element compounds include zirconium, titanium or hafnium compounds, or a mixture of two or more of such compounds.

The thickness of the support can be varied. In most applications, the thickness should be sufficient to sustain the wear from printing and thin enough to wrap around a printing form (including a cylinder). A preferred embodiment uses a support comprising, for example, a polyethylene terephthalate or polyethylene naphthalate substrate, gelatin interlayer, and a titanium oxide layer containing a polymeric binder, and having a thickness of from about 100 to about 310 $\mu$m. Another preferred embodiment uses a metal (such as aluminum) substrate and the entire support has a thickness of from about 100 to about 600 $\mu$m. The support should resist dimensional change under conditions of use.

The support can also be a cylindrical surface having an interlayer containing one or more Group IVB compounds coated thereon, and the heat-sensitive imaging polymer composition coated on the interlayer, and can thus be an integral part of the printing press. The use of such cylinders is described for example in U.S. Pat. No. 5,713,287 (Gelbart). Such cylinders can also be treated or coated as noted above to provide the desired interlayer, and the heat-sensitive composition can be applied to the interlayer using conventional techniques including spraying.

The Group IVB compounds useful in the practice of this invention include compounds containing elements such as titanium, hafnium or zirconium. The preferred compounds contain titanium or zirconium, and the most preferred compounds include titanium. These compounds can be titanium, hafnium and zirconium oxides (including dioxides and trioxides), fluorotitanates (such as hexafluorotitanate), fluorohafnates (such as hexafluorohafnate) and fluorozirconates (such as hexafluorozirconate). Oxides such as titanium dioxide are preferred in an interlayer on polyester supports. Mixtures of compounds having the same or different Group IVB element can be used if desired. For example, a titanium oxide can be used with hexafluorotitanate, or hexafluorotitanate can be used with hexafluorozirconate.

The oxides are preferably crosslinked with a suitable crosslinking agent to further enhance the integrity of the layer. Useful crosslinking agents include, but are not limited to, silanes including substituted or unsubstituted alkyldi- or alkyltrialkoxysilanes (such as tetraethoxysilane, phenyltrimethoxysilane, phenyltriethoxysilane, ethyltrimethoxysilane, 3-aminopropyltriethoxysilane, methacryloxypropyltrimethoxysilane, aminoethylaminopropyltrimethoxysilane, triethoxysilanylethane and octyltriethoxysilane), epoxy-substituted di- or trialkoxysilanes (such as 3-glycidoxypropyltriethoxysilane), hafnium isopropoxide, zirconium isopropoxide and copper bis(2,2,6,6-tetramethyl)-3,5-heptanedionate.

The amount of crosslinking agent used with the oxide will vary with the amount of oxide and the particular crosslinking agent used. Generally, the amount of crosslinking agent is at least 2 weight %, and preferably at least 5 weight %, based on total dry weight of oxide.

Preferably, the Group IVB element compounds (such as oxides) are also mixed with one or more film-forming and hydrophilic binders that help provide physical integrity to the interlayer. Useful hydrophilic binders include, but are not limited to polyvinyl alcohol, hardened gelatin (and derivatives thereof) or other hardened hydrophilic colloids, hydrophilic acrylate and methacrylate polymers, pyridine-containing polymers and polyvinyl pyrrolidones. Polyvinyl alcohol and hardened gelatin are the most preferred binders.

The level of Group IVB element compound (such as oxides) in the interlayer is generally at least 10 weight % and preferably at least 15 weight % (based on total dry weight). The maximum amount of this compound can be 100 weight %, but for practical purposes, it is up to 50 weight % (based on total dry weight).

In some embodiments, a mixture of Group IVB element compounds is used. For example, a Group IVB oxide such as titanium oxide can be mixed with other metal oxides including, but not limited to, silicon dioxide, aluminum oxide, zirconium oxide, antimony oxide, beryllium oxide, lead oxide and transition metal oxides, as well as various oxide alloys, such as those described in U.S. Pat. No. 5,855,173 (Chatterjee et al). Where other oxides are present, the ratio of titanium oxide to the other oxides is generally less than 100:1, and preferably from about 10:1 to about 2:1. Mixtures of compounds other than oxides would be readily apparent to one skilled in the art.

The backside of the support may be coated with antistatic agents and/or slipping layers or matte layers to improve handling and "feel" of the imaging member.

The imaging member, however, preferably has only one layer on the imaging side above the interlayer, that is the heat-sensitive layer that is required for imaging. The hydrophilic imaging layer includes one or more heat-sensitive thiosulfate polymers, and optionally but preferably a photothermal conversion material (described below). This layer preferably provides the outer printing surface. Because of the particular heat-sensitive polymer(s) used in the imaging layer, the exposed (imaged) areas of the layer are rendered more hydrophobic (or oleophilic) in nature. The unexposed areas remain hydrophilic and if desired can be washed off with a fountain solution on press, or developed in tap water after imaging.

In the heat-sensitive layer of the imaging members, only the heat-sensitive polymer and optionally the photothermal conversion material are necessary or essential for imaging.

Each of the heat-sensitive thiosulfate polymers useful in this invention has a molecular weight of at least 1000, and preferably of at least 5000. The polymers can be vinyl homopolymers or copolymers prepared from one or more ethylenically unsaturated polymerizable monomers that are reacted together using known polymerization techniques and reactants. Alternatively, they can be addition homopolymers or copolymers (such as polyethers) prepared from one or more heterocyclic monomers that are reacted together using known polymerization techniques and reactants. Additionally, they can be condensation type polymers (such as polyesters, polyimides, polyamides or polyurethanes) prepared using known polymerization techniques and reactants. Whatever the type of polymers, at least 10 mol % of the total recurring units in the polymer comprise the necessary heat-activatable thiosulfate groups that can be provided using any suitable technique known to a polymer chemist. The heat-activatable thiosulfate groups in these polymers are represented by the following Structure I:

I

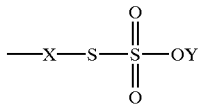

wherein X is a divalent linking group (defined below), and Y is hydrogen or a suitable cation (also defined below).

The preferred heat-sensitive thiosulfate polymers useful in the practice of this invention can be represented by the following structure II wherein the thiosulfate group (or Bunte salt) is a pendant group:

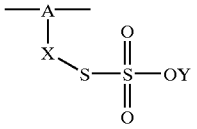

wherein A represents a polymeric backbone and X and Y are as defined below.

Useful polymeric backbones include, but are not limited to, vinyl polymers, polyethers, polyimides, polyamides, polyurethanes and polyesters. Preferably, the polymeric backbone is a vinyl polymer or polyether.

Useful "X" linking groups include —$(COO)_n(Z)_m$— wherein n is 0 or 1, m is 0 or 1, and Z is a substituted or unsubstituted alkylene group having 1 to 6 carbon atoms (such as methylene, ethylene, n-propylene, isopropylene, butylenes, 2-hydroxypropylene and 2-hydroxy-4-azahexylene) that can have one or more oxygen, nitrogen or sulfur atoms in the chain, a substituted or unsubstituted arylene group having 6 to 14 carbon atoms in the aromatic ring (such as phenylene, naphthalene, anthracylene and xylylene), or a substituted or unsubstituted arylenealkylene (or alkylenearylene) group having 7 to 20 carbon atoms in the chain (such as p-methylenephenylene, phenylenemethylene-phenylene, biphenylene and phenyleneisopropylenephenylene). In addition, X can be an alkylene group, an arylene group, in an arylenealkylene group as defined above for Z.

Preferably, X is an alkylene group of 1 to 3 carbon atoms, an arylene group of 6 carbon atoms in the aromatic ring, an arylenealkylene group of 7 or 8 carbon atoms in the chain, or —$COO(Z)_m$— wherein Z is a methylene, ethylene or phenylene group. Most preferably, X is a phenylene, methylene or —COO— group.

Y is hydrogen, ammonium ion, or a metal ion (such as sodium, potassium, magnesium, calcium, cesium, barium, zinc or lithium ion). Preferably, Y is hydrogen, sodium ion or potassium ion.

As the thiosulfate group is generally pendant to the backbone, preferably it is part of an ethylenically unsaturated polymerizable monomer that can be polymerized using conventional techniques to form vinyl homopolymers of the thiosulfate-containing recurring units, or vinyl copolymers when copolymerized with one or more additional ethylenically unsaturated polymerizable monomers. The thiosulfate-containing recurring units generally comprise at least 10 mol % of all recurring units in such polymers, preferably they comprise from about 15 to 100 mol % of all recurring units, and more preferably, they comprise from about 15 to about 50 mol % of all recurring units. A polymer can include more than one type of repeating unit containing a thiosulfate group as described herein.

Polymers having the above-described thiosulfate group are believed to be crosslinked, converting hydrophilic thiosulfate groups to hydrophobic disulfide groups (upon loss of sulfate) with heating and water. Hence, the imaging member is a negative-working imaging member.

Thiosulfate-containing molecules (or Bunte salts) can be prepared from the reaction between an alkyl halide and thiosulfate salt as taught by Bunte, *Chem.Ber.* 7, 646, 1884. Polymers containing thiosulfate groups can either be prepared from functional monomers or from preformed polymers. If the polymer is a vinyl polymer, the functional vinyl polymerizable monomer can be prepared as illustrated below:

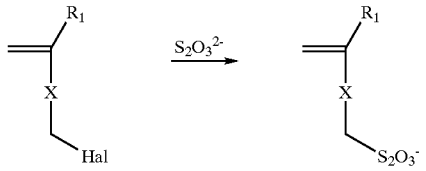

wherein $R_1$ is hydrogen or an alkyl group, Hal is halide, and X is a divalent linking group (defined above).

Polymers can also be prepared from preformed polymers in a similar manner as described in U.S. Pat. No. 3,706,706 (Vandenberg):

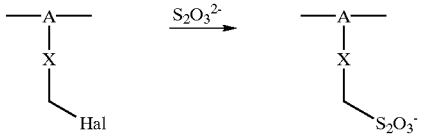

Thiosulfate-containing molecules can also be prepared by reaction of an alkyl epoxide with a thiosulfate salt, or between an alkyl epoxide and a molecule containing a thiosulfate moiety (such as 2-aminoethanethiosulfuric acid), and the reaction can be performed either on a monomer or polymer as illustrated by Thames, *Surf. Coating,* 3 (Waterborne Coat.), Chapter 3, pp. 125–153, Wilson et al (Eds.):

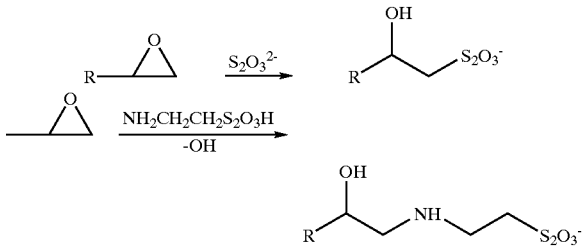

Representative synthetic methods for making ethylenically unsaturated polymerizable monomers and polymers useful in the practice of this invention are illustrated as follows:

Synthesis Example 1

Synthesis of poly[vinyl benzyl thiosulfate sodium salt -co-N-(3-aminopropyl)methacrylamide hydrochloride] from monomer Vinyl benzyl chloride (20 g, 0.131 mol) was dissolved in 50 ml of ethanol in a 250 ml round-bottomed flask and placed in a 30° C. water bath. Sodium thiosulfate (18.8 g, 0.119 mol) was dissolved in 60 ml of 2:1 ethanol:water mixture, added to an addition funnel, and dripped into vinyl benzyl chloride solution over a period of 60 minutes. The reaction was stirred warm for additional 2 hours. Solvent was then evaporated and the white solid was dissolved in hot ethanol and hot filtered. White crystalline product was formed in the filtrate.

The resulting monomer (2 g, 8 mmol), 3-aminopropyl methacrylamide hydrochloride (0.16 g, 0.8 mmol), and 4,4'-azobis(4-cyanovaleric acid) (75% in water, 30 mg) were added to a 25 ml round-bottomed flask. The solution was purged with dry nitrogen for 15 minutes and then heated at 60° C. overnight. After cooling to room temperature, the solution was dialyzed against water overnight. The resulting polymer was subject to characterization and imaging testing.

Synthesis Example 2

Synthesis of poly(vinyl benzyl thiosulfate sodium salt) from polymer

Vinyl benzyl chloride (21.5 g, 0.141 mol) and azobisisobutylronitrile (hereafter referred to as "AIBN") (0.25 g, 1.5 mmol) were dissolved in 50 ml of toluene. The solution was purged with dry nitrogen and then heated at 65° C. overnight. After cooling to room temperature, the solution was diluted to 100 ml and added dropwise to 1000 ml of isopropanol. The white powdery polymer was collected by filtration and dried under vacuum at 40° C. overnight.

This polymer (10 g) was dissolved in 150 ml of N,N'-dimethylformamide. To this solution was added sodium thiosulfate (10.44 g, 0.066 mol) and 30 ml of water. Some polymer precipitated out. The cloudy reaction mixture was heated at 95° C. for 12 hours. After cooling to room temperature, the hazy reaction mixture was dialyzed against water. A small amount of the resulting polymer solution was freeze dried for elemental analysis and the rest of the polymer solution was subject to imaging testing. Elemental analysis indicated the reaction conversion was 99 mol %.

Synthesis Example 3

Synthesis of poly(chloromethyl-ethylene oxide-co-sodium thiosulfate methyl-ethylene oxide) from polymer Poly(epichlorohydrin) (Aldrich Chemical Company, $M_n$=700,000) (10 g) was dissolved in 250 ml of anhydrous dimethylsulfoxide (DMSO) and anhydrous sodium thiosulfate (17.0 g) was added. The mixture was heated at 65° C. for 24 hours. After cooling to room temperature, the hazy reaction mixture was dialyzed against water. A small amount of the resulting polymer solution was freeze dried for elemental analysis and the rest of the polymer solution was subject to imaging testing. Elemental analysis indicated the reaction conversion to sodium thiosulfate was 16 mol %.

In another reaction of the same scale, the reaction mixture was heated at 85° C. for 40 hours. Elemental analysis of the resulting polymer indicated the conversion to sodium thiosulfate was 26 mol %. When the reaction was carried out at 65° C. for 18 hours, the conversion to sodium thiosulfate was 13 mol %.

Synthesis Example 4

Synthesis of poly(vinyl benzyl thiosulfate sodium salt-co-methyl methacylate) from polymer: Polymer 1

Vinyl benzyl chloride (10 g, 0.066 mol), methyl methacrylate (15.35 g, 0.153 mol) and AIBN (0.72 g, 4 mmol) were dissolved 120 ml of toluene. The solution was purged with dry nitrogen and then heated at 65° C. overnight. After cooling to room temperature, the solution was dropwise added to 1200 ml of isopropanol. The resulting white powdery polymer was collected by filtration and dried under vacuum at 60° C. overnight. $^1$H NMR analysis indicate that the copolymer contained 44 mol % of vinyl benzyl chloride.

This polymer (16 g) was dissolved in 110 m of N,N'-dimethylformamide. To this solution was added sodium thiosulfate (12 g) and water (20 ml). Some polymer precipitated out. The cloudy reaction mixture was heated at 90° C. for 24 hours. After cooling to room temperature, the hazy reaction mixture was dialyzed against water. A small amount of the resulting polymer solution was freeze dried for elemental analysis and the rest of the polymer solution was subject to imaging testing. Elemental analysis indicated that all the vinyl benzyl chloride was converted to sodium thiosulfate salt.

Polymer 2 was similarly prepared using methyl acrylate instead of methyl methacrylate.

Synthesis Example 5

Synthesis of poly(2-sodium thiosulfate-ethyl methacrylate)

2-Chloroethyl methacrylate (10 g, 0.067 mol) and AIBN (0.11 g, 0.7 mmol) were dissolved in 20 ml of tetrahydrofuran. The solution was purged with dry nitrogen and then heated at 60° C. for 17 hours. After cooling to room temperature, the solution was diluted to 80 ml and added dropwise to 800 ml of methanol. The resulting white powdery polymer was collected by filtration and dried under vacuum at 40° C. overnight.

The above polymer (5 g) was dissolved in 50 ml of N,N'-dimethylformamide. To this solution was added sodium thiosulfate (5.3 g) and water (10 ml). Some polymer precipitated out. The cloudy reaction mixture was heated at 90° C. for 52 hours. After cooling to room temperature, the reaction mixture was dialyzed against water. A small amount of the resulting polymer solution was freeze dried for elemental analysis and the rest of the polymer solution was subject to imaging testing. Elemental analysis indicated that the conversion to sodium thisosulfate was 90 mol %.

Synthesis Example 6

Synthesis of poly(2-hydroxy-3-sodium thiosulfate-propyl methacrylate-co-2-(methacryloyloxy)ethyl acetoacetate) from polymer Glycidyl methacrylate (20.8 g, 0.146 mol), (methacryloyloxy)ethyl acetoacetate (2.72 g, 0.013 mol), and AIBN (0.52 g) were dissolved in 110 ml of N,N'-dimethylformamide in a 250 ml round-bottomed flask capped with a rubber septum. The solution was purged with dry nitrogen for 15 minutes and then heated at 60° C. for 15 hours. The product was diluted with 20 ml of N,N'-dimethylformamide and purified by precipitated into 1200 ml of isopropanol. The resulting white powdery polymer was filtered and dried under vacuum at 40° C. overnight.

The above polymer (10 g) was dissolved in 150 ml of N,N'-dimethylformamide. To this solution was added sodium thiosulfate (11 g) and water (30 ml). Some polymer precipitated out. The cloudy reaction mixture was heated at 65° C. for 24 hours. After cooling to room temperature, the hazy reaction mixture was dialyzed against water. Small amount of the resulting polymer solution was freeze-dried for elemental analysis and the rest of the polymer solution was subject to imaging testing. Elemental analysis indicated complete conversion of glycidyl methacrylate to sodium thiosulfate salt.

Synthesis Example 7

Synthesis of poly(4-aza-2-hydroxy-6-sodium thiosulfate-hexyl methacrylate) from monomer Sodium hydroxide (4.5 g 0.112 mol) and 2-aminoethanethio-sulfuric acid (8.85 g, 0.056 mol) were dissolved in 15 ml of water in a 100 ml round-bottomed flask and cooled in an ice bath. Glycidyl methacrylate (8 g, 0.056 mol) was dissolved in 15 ml of tetrahydrofuran and added slowly to the above solution, keeping the temperature below 25° C. The reaction was followed by thin layer chromatography. After the completion of the reaction, 4,4'-azobis(4-cyanovaleric acid) (75% in water, 0.52 g, 1.4 mmol) was added to the reaction flask. The flask was capped with a septum, purged with dry nitrogen for 15 minutes, and then heated at 60° C. for 17 hours. After cooling to room temperature, the solution was dialyzed against water overnight. The resulting polymer was subject to characterization and imaging testing.

As illustrated, vinyl polymers can be prepared by copolymerizing monomers containing the thiosulfate functional groups with one or more other ethylenically unsaturated polymerizable monomers to modify polymer chemical or functional properties, to optimize imaging member performance, or to introduce additional crosslinking capability.

Useful additional ethylenically unsaturated polymerizable monomers include, but are not limited to, acrylates (including methacrylates) such as ethyl acrylate, n-butyl acrylate, methyl methacrylate and t-butyl methacrylate, acrylamides (including methacrylamides), an acrylonitrile (including methacrylonitrile), vinyl ethers, styrenes, vinyl acetate, dienes (such as ethylene, propylene, 1,3-butadiene and isobutylene), vinyl pyridine and vinylpyrrolidone. Acrylamides, acrylates and styrenes are preferred.

Polyesters, polyamides, polyimides, polyurethanes and polyethers are prepared from conventional starting materials and using known procedures and conditions.

A mixture of heat-sensitive polymers described herein can be used in the imaging layer of the imaging members, but preferably only a single polymer is used. The polymers can be crosslinked or uncrosslinked when used in the imaging layer. If crosslinked, the crosslinkable moiety is preferably provided from one or more of the additional ethylenically unsaturated polymerizable monomers when the polymers are vinyl polymers. The crosslinking cannot interfere with the heat activation of the thiosulfate group during imaging.

The imaging layer of the imaging member can include one or more of such homopolymers or copolymers, with or without minor (less than 20 weight % based on total layer dry weight) amounts of additional binder or polymeric materials that will not adversely affect its imaging properties. However, the imaging layer includes no additional materials that are needed for imaging, especially those materials conventionally required for wet processing with alkaline developer solutions (such as novolak or resole resins).

The amount of heat-sensitive polymer(s) used in the imaging layer is generally at least 0.1 $g/m^2$, and preferably from about 0.1 to about 10 $g/m^2$ (dry weight). This generally provides an average dry thickness of from about 0.1 to about 10 $\mu$m.

The imaging layer can also include one or more conventional surfactants for coatability or other properties, or dyes or colorants to allow visualization of the written image, or any other addenda commonly used in the lithographic art, as long as the concentrations are low enough so that they are inert with respect to imaging or printing properties.

The heat-sensitive composition in the imaging layer preferably includes one or more photothermal conversion materials to absorb appropriate energy from an appropriate source (such as a laser), which radiation is converted into heat. Preferably, the radiation absorbed is in the infrared and near-infrared regions of the electromagnetic spectrum. Such materials can be dyes, pigments, evaporated pigments, semiconductor materials, alloys, metals, metal oxides, metal sulfides or combinations thereof, or a dichroic stack of materials that absorb radiation by virtue of their refractive index and thickness. Borides, carbides, nitrides, carbonitrides, bronze-structured oxides and oxides structurally related to the bronze family but lacking the $WO_{2.9}$ component, are also useful.

One particularly useful pigment is carbon of some form (for example, carbon black). Carbon blacks that are surface-functionalized with solubilizing groups are well known in the art and these types of materials are also useful as photothermal conversion materials in the practice of this invention. Carbon blacks that are grafted to hydrophilic, nonionic polymers, such as FX-GE-003 (manufactured by Nippon Shokubai), or that are surface-functionalized with anionic groups, such as CAB-O-JET 200 or CAB-O-JET 300 (Cabot Corporation) are particularly useful for this purpose.

Useful heat absorbing dyes for near infrared diode laser beams are described, for example, in U.S. Pat. No. 4,973,572 (DeBoer), incorporated herein by reference. Particular dyes of interest are "broad band" dyes, that is those that absorb over a wide band of the spectrum. Mixtures of pigments, dyes, or both, can also be used. Particularly useful infrared radiation absorbing dyes and pigments include those illustrated as follows:

IR Dye 1

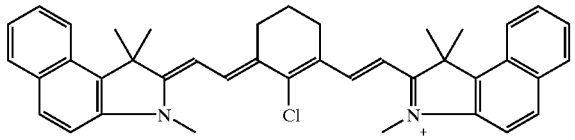

p-Toluenesulfonate

IR Dye 2 Same as IR Dye 1 but with $C_3F_7CO2^-$ as the anion.

IR Dye 3

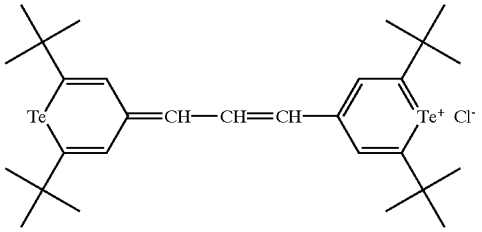

IR Dye 4

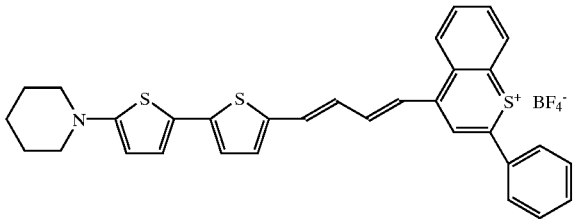

IR Dye 5

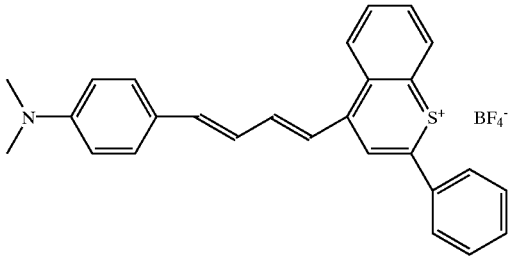

IR Dye 6

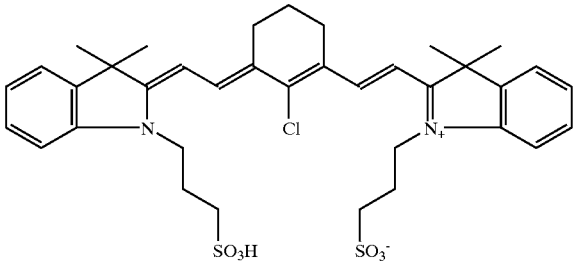

IR Dye 7 Same as IR Dye 1 but with chloride as the anion

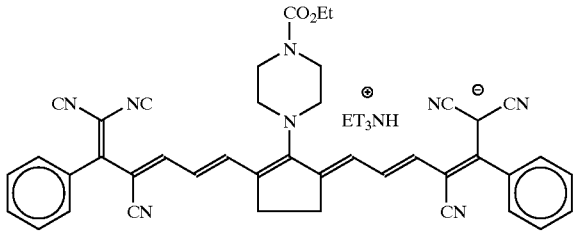

Other useful IR dyes are multisulfonated compounds such as those described in copending U.S. Ser. No. 09/387,021 filed Aug. 31, 1999 by Fleming et al. Useful oxonol compounds that are infrared radiation sensitive include compounds described in copending U.S. Ser. No. 09/444,695 filed Nov. 22, 1999 by DoMinh et al.

The photothermal conversion material(s) are generally present in an amount sufficient to provide an optical density of at least 0.3 (preferably of at least 0.5 and more preferably of least 1.0) at the operating wavelength of the imaging laser. The particular amount needed for this purpose would be readily apparent to one skilled in the art, depending upon the specific material used.

Alternatively, a photothermal conversion material can be included in a separate layer that is in contact with the heat-sensitive imaging layer. Thus, during imaging, the action of the photothermal conversion material can be transferred to the heat-sensitive polymer layer without the material originally being in the same layer.

The interlayer formulation described above (containing a Group IVB element compound) and the heat-sensitive composition can be applied to the support using any suitable equipment and procedure, such as spin coating, knife coating, gravure coating, dip coating or extrusion hopper coating. The heat-sensitive composition is applied to a support that already has the interlayer disposed thereon either by coating or by support treatment. A useful laminate of support and interlayer is available as MYRIAD 2 substrate from Xanté Corporation (Mobile, Ala.). Examples of making the imaging members of this invention are provided in Examples 1–7 below.

In one embodiment, a method of imaging comprises:

A) providing a support having a interlayer comprising a Group IVB element compound disposed thereon, B) spray coating onto the interlayer a heat-sensitive composition comprising a heat-sensitive thiosulfate polymer to form an imaging member, and C) imagewise exposing the imaging member to provide exposed and unexposed areas on the surface of the imaging member, whereby the exposed areas are rendered more hydrophobic than the unexposed areas by heat provided by the imagewise exposing.

The imaging members of this invention can be of any useful form including, but not limited to, printing plates, printing cylinders, printing sleeves and printing tapes (including flexible printing webs). Preferably, the imaging members are printing plates.

Printing plates can be of any useful size and shape (for example, square or rectangular) having the requisite heat-sensitive imaging layer and interlayer disposed on a suitable support. Printing cylinders and sleeves are known as rotary printing members in a cylindrical form. Hollow or solid metal cores can be used as supports for printing sleeves.

During use, the imaging member of this invention can be exposed to any suitable source of energy that generates or provides heat, such as a focused laser beam or thermoresistive head, in the imaged areas, typically from digital information supplied to the imaging device. A laser used to expose the imaging member of this invention is preferably a diode laser, because of the reliability and low maintenance of diode laser systems, but other lasers such as gas or solid state lasers may also be used. The combination of power, intensity and exposure time for laser imaging would be readily apparent to one skilled in the art. Specifications for lasers that emit in the near-IR region, and suitable imaging configurations and devices are described in U.S. Pat. No. 5,339,737 (Lewis et al), incorporated herein by reference. The imaging member is typically sensitized so as to maximize responsiveness at the emitting wavelength of the laser. For dye sensitization, the dye typically is chosen such that its $\gamma_{max}$ closely approximates the wavelength of laser operation.

The imaging apparatus can operate on its own, functioning solely as a platemaker, or it can be incorporated directly into a lithographic printing press. In the latter case, printing may commence immediately after imaging, thereby reducing press set-up time considerably. The imaging apparatus can be configured as a flatbed recorder or as a drum recorder, with the imaging member mounted to the interior or exterior cylindrical surface of the drum.

In the drum configuration, the requisite relative motion between the imaging device (such as a laser beam) and the imaging member can be achieved by rotating the drum (and the imaging member mounted thereon) about its axis, and moving the imaging device parallel to the rotation axis, thereby scanning the imaging member circumferentially so the image "grows" in the axial direction. Alternatively, the imaging device can be moved parallel to the drum axis and, after each pass across the imaging member, increment angularly so that the image "grows" circumferentially. In both cases, after a complete scan an image corresponding (positively or negatively) to the original document or picture can be applied to the surface of the imaging member.

In the flatbed configuration, a laser beam is drawn across either axis of the imaging member, and is indexed along the other axis after each pass. Obviously, the requisite relative motion can be produced by moving the imaging member rather than the laser beam.

While laser imaging is preferred in the practice of this invention, any other imaging means can be used that provides thermal energy in an imagewise fashion. For example, imaging can be accomplished using a thermoresistive head (or thermal printing head) in what is known as "thermal printing", as described for example, in U.S. Pat. No. 5,488,025 (Martin et al), incorporated herein by reference. Such thermal printing heads are commercially available (for example as Fujitsu Thermal Head FTP-040 MCS001 and TDK Thermal Head F415 HH7-1089).

After imaging, the imaging member can be used for printing by applying a lithographic ink to the image on its printing surface that has been moistened with water or a fountain solution, and by transferring the ink to a suitable receiving material (such as cloth, paper, metal, glass or plastic) to provide a desired impression of the image thereon. If desired, an intermediate "blanket" roller can be used in the transfer of the ink from the imaging member to the receiving material. The imaging members can be cleaned between impressions, if desired, using conventional cleaning means.

The following examples illustrate the practice of the invention, and are not meant to limit it in any way.

In these examples, a thermal IR-laser platesetter was used to image the printing plates, the printer being similar to that described in U.S. Pat. No. 5,168,288 (Baek et al), incorporated herein by reference. The printing plates were exposed using approximately 450 mW per channel, 9 channels per swath, 945 lines/cm, a drum circumference of 53 cm and an image spot (1/e2) at the image plane of about 25 $\mu$m. The test image included text, positive and negative lines, half tone dot patterns and a half-tone image. Images were printed at speeds up to 1100 revolutions per minute (the exposure levels do not necessarily correspond to the optimum exposure levels for the tested printing plates).

EXAMPLES 1–2

In these examples, a heat-sensitive thiosulfate formulation was prepared as indicated in Table I below for Examples 1 and 2.

TABLE I

| COMPONENTS | PARTS BY WEIGHT |
|---|---|
| Polymer 1 | 0.30 |
| IR Dye 1 | 0.06 |
| Deionized water | 4.70 |
| Methanol | 3.94 |

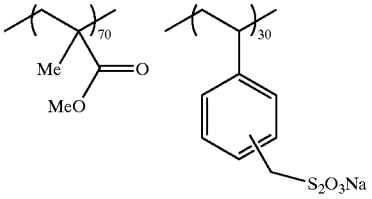

Polymer 1

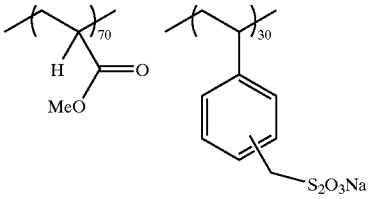

Polymer 2

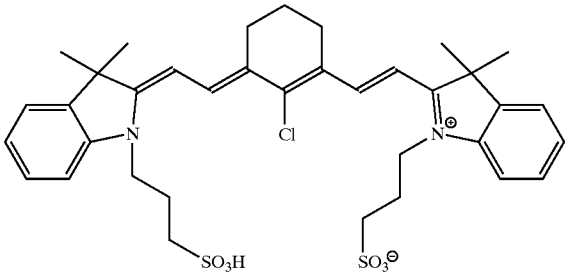

IR Dye 6

This formulation was coated at a dry coating weight of about 1.0–1.2 g/m$^2$ onto a grained and anodized 0.14 mm-thick aluminum support to provide a Control A printing plate.

The same formulation was coated onto a poly(ethylene terephthalate) support that had been previously coated with an interlayer from a formulation of titanium dioxide dispersed in polyvinyl alcohol and a crosslinking agent tetraethoxysilane (TEOS) to form the Example 1 printing plate. This typical formulation is shown in TABLE II.

TABLE II

| | |
|---|---|
| $TiO_2$ | 73% |
| Polyvinyl alcohol | 14% |
| TEOS | 13% |

Dry coating weight of 5 g/m$^2$.

A commercial 0.10 mm polyester material containing such composition as an interlayer has been described in EP 0 830,940 Al and EP 0 830,941 A1), and is marketed by Xanté Corporation (Mobile, Ala.) under the trade name MYRIAD 2. This laminate was used in most of the examples described herein.

Similar formulations were also prepared for Control B and Example 2 except the IR Dye 1 was used only at half concentration (see TABLE III).

Each printing plate was dried in a convection oven at 82° C. for 3 minutes and was imaged at 830 nm on the platesetter described above using radiation doses ranging from 360 to 820 mJ/cm$^2$. The resulting blue-green surface coatings discolored rapidly to a tan color in the exposed regions. Each imaged printing plate was mounted on the plate cylinder of a full-page press (A. B. Dick 9820 Duplicator) for actual press run using Varn Universal Pink fountain solution (from Vam Products Co.) and conventional black ink. Each printing plate developed on press within 60 seconds and rolled up quickly to print with full density and clean background for 1,000 impressions.

Analysis of the photospeed results (TABLE III), however, indicates that compared to the Control A and B plates, the Example 1 and 2 plates containing the titanium-containing interlayer (even at half the dye concentration in Example 2), provided equal or higher photospeed that remained constant at both IR dye concentrations.

TABLE III

| Printing Plate | IR Dye Concentration | Support | Photospeed (mJ/cm$^2$) |
|---|---|---|---|
| Control A | 0.06 | Aluminum | 360 |
| Example 1 | 0.06 | MYRIAD 2 laminate | 360 |
| Control B | 0.03 | Aluminum | 820 |
| Example 2 | 0.03 | MYRIAD 2 laminate | 360 |

EXAMPLE 3

Printing plates like those described in Examples 1 and 2 were prepared using Polymer 1 and IR Dye 1 in the heat-sensitive imaging layer but with various support materials, with and without an interlayer. The printing plate labeled as Control C comprised an untreated aluminum support and no interlayer. The Example 3 printing plate was like that described for Example 2. The Control D printing plate comprised a 0.1 mm-thick poly(ethylene terephthalate) (PET) support coated with a conventional hardened gelatin interlayer. The Control E printing plate comprised the same polyester printing plate coated with a hardened gelatin interlayer formulated from the composition shown in the following TABLE IV.

TABLE IV

| | |
|---|---|
| $Sn_2O_4$ | 10.75% |
| $ZnSb_2O_6$ | 50.24% |
| Gelatin | 39.03% |

Dry coating weight of 0.4 g/m$^2$.

Samples of each printing plate were imaged (360–820 mJ/cm$^2$ at 830 nm) and subjected to a wear test on the A. B. Dick press under conditions similar to Examples 1 and 2. The results, summarized in TABLE V, indicated that the run length provided by this invention (Example 3) matched that of Control C having an untreated aluminum support but exceeded that of Controls D and E that included interlayers outside the scope of the present invention by 30 times.

TABLE V

| PRINTING PLATE | SUPPORT | RUN LENGTH (# of printed sheets) |
|---|---|---|
| Control C | Untreated Aluminum | 30,000 |
| Example 3 | MYRIAD 2 laminate | 30,000 |
| Control D | Hardened gelatin on PET | 1,000 |
| Control E | $Sn_2O_4$ + $ZnSb_2O_6$ + gelatin on PET | 1,000 |

EXAMPLE 4

Two additional printing plates were prepared as described in Examples 1 and 2, except the heat-sensitive thiosulfate was Polymer 2. Each printing plate was prepared and imaged as described in Examples 1 and 2. The Control F printing plate contained an untreated aluminum support and no interlayer.

Samples of the imaged printing plates were run on the A. B. Dick press for 1,000 impressions to test for photospeed and the rate of roll-up. The results, summarized in TABLE VI, indicate that the plate having the interlayer (Example 4) exhibited improved photospeed and rolled up faster than the Control F printing plate.

TABLE VI

| PRINTING PLATE | SUPPORT | PHOTOSPEED (mJ/cm$^2$) | PRESS ROLL-UP (# sheets to clean) |
|---|---|---|---|
| Control F | Untreated aluminum | 820 | 75 |
| Example 4 | MYRIAD 2 laminate | 450 | 25 |

EXAMPLE 5

Two additional printing plates were prepared identically as described in Example 1. The Control G printing plate contained an untreated aluminum support and no interlayer. Samples of the two type printing plates were divided into 2 groups: freshly prepared and those kept at room temperature for 10 days. All printing plates were imaged as described above and were press tested at different times for their ability for on-press processing.

The results (TABLE VII) show that the printing plate of this invention (Example 5) rolled up consistently well they were used immediately or after room temperature aging. However, the Control G printing plate failed to develop on press after the aging test.

TABLE VII

| | | ON PRESS RESULTS | |
|---|---|---|---|
| PRINTING PLATE | SUPPORT | Fresh | 10 days aging |
| Control G | Untreated aluminum | Good | No development |
| Example 5 | MYRIAD 2 laminate | Good | Good |

EXAMPLES 6 and 7

Four printing plates were prepared similarly to those described in Examples 1 and 2 except that the substrates and interlayers were changed (the heat-sensitive layers were the same as in those examples). An electrochemically grained and sulfuric acid anodized aluminum support (0.14 mm) was used for each printing plate.

For Control H, the support was then treated with a vinyl phosphonic acid acrylamide copolymer as described in U.S. Pat. No. 5,368,974 (Walls et al) following by application of the thiosulfate-containing heat-sensitive imaging layer. For Control I, the aluminum support was used without the noted copolymer.

The Example 6 printing plate comprised an interlayer between the heat-sensitive layer and the aluminum support. Prior to coating the heat-sensitive layer, the aluminum support was further treated with an aqueous solution of potassium hexafluorotitantate ($K_2TiF_6$) at 1.8 weight % at 53° C. for 120 seconds. This treatment was followed by neutralization with an aqueous solution of tetrapotassium pyrophosphate ($K_4P_2O_7$) at 0.3 weight % at 55° C. This procedure is outlined in more detail in U.S. Pat. No. 3,440,050 (noted above).

The Example 7 printing plate was rinsed with an alkaline solution to remove the acidic copolymer interlayer prior to treatment with the solution of potassium hexafluorotitantate as noted above.

The following TABLE VIII shows the run lengths achieved using each printing plate. It is believed that the Control printing plates fail the press run because of inadequate adhesion of the heat-sensitive layer to the aluminum supports. However, the treatment of the aluminum supports to provide the titanium (Ti)-containing interlayer significantly improved adhesion and printing plate performance.

TABLE VIII

| PRINTING PLATE | SUPPORT | RUN LENGTH (# of impressions) |
|---|---|---|
| Control H | Aluminum with copolymer treatment | None |
| Control I | Aluminum without copolymer treatment | None |
| Example 6 | Aluminum with copolymer and Ti-containing interlayer | 1000 |
| Example 7 | Aluminum without copolymer and Ti-containing interlayer | 1000 |

EXAMPLES 8 and 9

For Example 8, a phosphoric acid anodized aluminum support was treated with an aqueous solution of hexafluorozirconate (2.2 weight %) at 57° C. for 60 seconds to provide an interlayer, followed by neutralization with an aqueous solution of tetrapotassium pyrophosphate (0.3 weight %) at 60° C. for 30 seconds. On this interlayer was coated the heat-sensitive imaging formulation as described herein.

Similarly, a second printing plate (Example 9) was prepared using an aqueous solution of potassium hexafluorotitanate (1.8 weight %) at 60° C. for 30 seconds, followed by neutralization with the tetrapotassium pyrophosphate solution.

The invention has been described in detail with particular reference to preferred embodiments thereof but it will be understood that variations and modifications can be effected within the spirit and scope of the invention.

We claim:

1. An imaging member comprising a support having thereon a hydrophilic imaging layer comprising a hydrophilic heat-sensitive thiosulfate polymer, and disposed between said support and said hydrophilic imaging layer, an interlayer comprising a Group IVB element compound.

2. The imaging member of claim 1 wherein said interlayer comprises a titanium compound.

3. The imaging member of claim 2 wherein said interlayer comprises a zirconium compound.

4. The imaging member of claim 1 wherein said Group IVB element compound is a titanium oxide present in said interlayer in an amount of at least 10 weight %.

5. The imaging member of claim 4 wherein said interlayer further comprises a crosslinking agent for said oxide, and a binder.

6. The imaging member of claim 5 wherein said crosslinking agent is a substituted or unsubstituted alkyldi- or alkyltrialkyloxysilane, and said binder is polyvinyl alcohol, hardened gelatin or a hydrophilic acrylate or methacrylate polymer.

7. The imaging member of claim 1 wherein said Group IVB compound is titanium dioxide.

8. The imaging member of claim 1 wherein said interlayer is formed by treating said support with a solution containing said Group IVB element compound prior to formation of said hydrophilic imaging layer.

9. The imaging member of claim 1 wherein said interlayer is formed by coating composition comprising said Group IVB element compound on said support prior to formation of said hydrophilic imaging layer.

10. The imaging member of claim 1 wherein said heat-sensitive thiosulfate polymer comprises recurring units comprising a heat-activatable thiosulfate group represented by structure I:

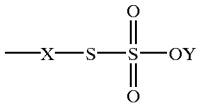

wherein X is a divalent linking group, and Y is a hydrogen or a cation.

11. The imaging member of claim 10 wherein X is an alkylene group, an arylene group, an arylenealkylene group, or $(COO)_nZ_m$ wherein n is 0 or 1 and m is 0 or 1, wherein at least one of m and n is not 0, and Z is an alkylene group, an arylene group, or an arylenealkylene group, and Y is hydrogen, ammonium ion, or a metal ion.

12. The imaging member of claim 11 wherein X is an alkylene group of 1 to 3 carbon atoms, an arylene of 6 carbon atoms in the aromatic ring, an arylenealkylene of 7 or 8 carbon atoms in the chain, or —COOZ wherein Z is methylene, ethylene or phenylene, and Y is hydrogen, sodium or potassium.

13. The imaging member of claim 10 wherein said recurring units comprising said heat-activatable thiosulfate group comprise at least 10 mol % of all recurring units in said heat-sensitive polymer.

14. The imaging member of claim 13 wherein said recurring units comprising said heat-activatable thiosulfate group comprise from about 15 to 50 mol % of all recurring units in said heat-sensitive polymer.

15. The imaging member of claim 1 wherein said heat-sensitive thiosulfate polymer is a vinyl polymer or polyether comprising heat-sensitive thiosulfate groups.

16. The imaging member of claim 1 wherein said imaging layer further comprises a photothermal conversion material.

17. The imaging member of claim 16 wherein said photothermal conversion material is an infrared radiation absorbing material.

18. The imaging member of claim 17 wherein said photothermal conversion material is carbon black, polymer grafted carbon or an IR radiation absorbing dye or pigment.

19. The imaging member of claim 1 wherein said support comprises a polyester substrate having thereon a crosslinked titanium oxide interlayer between said support and said hydrophilic imaging layer.

20. The imaging member of claim 1 wherein said support is an aluminum substrate that has been treated with an aqueous solution comprising a titanate or zirconate compound.

21. The imaging member of claim 20 wherein said support is treated with an aqueous solution comprising hexafluorotitanate, hexafluorozirconate, or a mixture thereof.

22. The imaging member of claim 1, wherein the imaging member is a lithographic printing plate precursor.

23. A method of imaging comprising:

A) providing the imaging member of claim 1, and

B) imagewise exposing said imaging member to provide exposed and unexposed areas in said imaging layer of said imaging member, whereby said exposed areas are rendered more hydrophobic than said unexposed areas by heat provided by said imagewise exposing.

24. The method of claim 23 wherein said imaging member further comprises a photothermal conversion material and said imagewise exposing is carried out using an IR radiation emitting laser.

25. The method of claim 23 wherein said imagewise exposing is carried out using a thermal printing head.

26. A method of printing comprising:

A) providing the imaging member of claim 1,

B) imagewise exposing said imaging member to provide exposed and unexposed areas on the surface of said imaging member, whereby said exposed areas are rendered more hydrophobic than said unexposed areas by heat provided by said imagewise exposing, and C) in the presence of water or a fountain solution, contacting said imagewise exposed imaging member with a lithographic printing ink, and imagewise transferring said printing ink from said imaging member to a receiving material.

27. The imaging member of claim 1 wherein said interlayer comprises a hafnium or zirconium compound.

28. The imaging member of claim 1 wherein said Group IVB element compound is a zirconium oxide present in said interlayer in an amount of at least 10 weight %.

29. The imaging member of claim 28 wherein said interlayer further comprises a crosslinking agent for said oxide, and a binder.

30. The imaging member of claim 29 wherein said crosslinking agent is a substituted or unsubstituted alkyldi- or alkyltrialkyloxysilane, and said binder is polyvinyl alcohol, hardened gelatin or a hydrophilic acrylate or methacrylate polymer.

31. The imaging member of claim 1 wherein said Group IVB compound is hexafluorozirconate or hexafluorotitanate.

32. A method of imaging comprising:

A) providing a support having a interlayer comprising a Group IVB element compound disposed thereon, B) spray coating onto said interlayer a heat-sensitive composition comprising a heat-sensitive thiosulfate polymer to form an imaging member, and C) imagewise exposing said imaging member to provide exposed and unexposed areas on the surface of said imaging member, whereby said exposed areas are rendered more hydrophobic than said unexposed areas by heat provided by said imagewise exposing.

33. The method of claim 32 wherein said support is an on-press printing cylinder or sleeve.

34. The method of claim 32 wherein said interlayer is disposed on said support by treating said support with a solution comprising a Group IVB element compound.

35. The method of claim 32 wherein said interlayer is disposed on said support by coating a composition comprising a Group IVB element compound thereon.

* * * * *